United States Patent [19]

Lewis

[11] 4,349,095

[45] Sep. 14, 1982

[54] COIN DISCRIMINATING APPARATUS

[75] Inventor: Christopher M. Lewis, Newmarket, England

[73] Assignee: P A Management Consultants Limited, London, England

[21] Appl. No.: 74,646

[22] Filed: Sep. 12, 1979

Related U.S. Application Data

[63] Continuation-in-part of Ser. No. 12,699, Feb. 16, 1979, abandoned.

[30] Foreign Application Priority Data

| | | | |
|---|---|---|---|
| Feb. 19, 1977 | [JP] | Japan | 52-18272 |
| Feb. 18, 1978 | [GB] | United Kingdom | 6539/78 |
| Aug. 30, 1978 | [GB] | United Kingdom | 34977/78 |
| Feb. 15, 1979 | [DE] | Fed. Rep. of Germany | 2905828 |
| Feb. 15, 1979 | [DE] | Fed. Rep. of Germany | 7904191[U] |
| May 9, 1979 | [GB] | United Kingdom | 7916065 |

[51] Int. Cl.[3] ..... G07F 3/02

[52] U.S. Cl. ..... 194/100 A; 194/97 R; 73/163

[58] Field of Search ..... 194/100 R, 100 A, 97 R; 73/163

[56] References Cited

U.S. PATENT DOCUMENTS

| | | | |
|---|---|---|---|
| 3,797,307 | 3/1974 | Johnston | 194/100 A X |
| 3,966,034 | 6/1976 | Heiman et al. | 194/100 A |
| 4,091,908 | 5/1978 | Hayashi et al. | 194/100 A |
| 4,108,296 | 8/1978 | Hayashi et al. | 194/100 A X |
| 4,249,648 | 2/1981 | Meyer | 194/102 |
| 4,254,857 | 3/1981 | Levasseur et al. | 194/100 A |

*Primary Examiner*—Joseph J. Rolla

*Attorney, Agent, or Firm*—Pollock, Vande Sande & Priddy

[57] ABSTRACT

A coin discriminating apparatus comprises two coils on opposite sides of a path for coins, one coil being connected to a signal generator so as to give repetitive abrupt flux changes and a gating device being provided for short circuiting the other coil but removing the short circuit a predetermined time delay after each flux change. A circuit is responsive to the amplitude of a voltage pulse which is produced across said other coil in response to each removal of the short circuit to discriminate between coins. This apparatus may form the second test of a two-test coin discriminating apparatus, wherein the first test measures a phase displacement caused by the coin passing between another pair of coils and this measurement is used to set the time delay to one of selected values, according to the expected coin, so that the voltage pulse will be of a constant amplitude for valid coins.

16 Claims, 16 Drawing Figures

| FIG.6A. | FIG.6B. | FIG.6C. | FIG.6D. |
|---|---|---|---|

COIN DISCRIMINATING APPARATUS

REFERENCE TO OTHER APPLICATION

This application is a continuation-in-part of application Ser. No. 012,699 filed Feb. 16, 1979 now abandoned.

BACKGROUND OF THE INVENTION

This invention relates to a coin discriminating apparatus for responding to coins of valid denominations, discriminating against non-valid denomination coins and forgeries, in coin operated apparatus.

Many coin operated apparatus exist in many different fields (for example dispensing machines, gaming machines, ticket machines). Protection is required against operation in response to dummy coins or forgeries and against operation in response to coins of the wrong denomination, for example lesser-value coins from countries other than the country of use. Specifically, the German 1DM coin needs protection against other coins of similar size and shape, such as the U.K. 5p coin, the Spanish 5PTAS, the Austrian 5sch and others.

SUMMARY OF THE INVENTION

As seen from one aspect, this invention provides a coin discriminating apparatus, comprising a transmitting coil connected to a signal generator so as to give an abrupt flux change, a receiving coil, the transmitting and receiving coils being disposed on opposite sides of a path for the passage of coins, means for short circuiting the receiving coil but effective to remove the short circuit a predetermined time delay after said flux change, and means responsive to the amplitude of a voltage pulse which is produced across the receiving coil in response to removal of said short circuit.

As seen from a second aspect, this invention provides coin discriminating apparatus, comprising a path for the passage of coins in a given direction and first and second coin testing means associated with said path, the first coin testing means being arranged to provide an output representing one of a number of categories to which different valid coin denominations belong, and the second coin testing means being adjusted in response to said output to test specifically for the valid coin denomination represented by said output.

This latter apparatus is intended for coin operated apparatus which is required to respond correctly to several different denomination coins, perhaps totalising the value of the coins accepted. The apparatus is then required to differentiate between the different valid denomination coins and to discriminate against, or reject, the non-valid coins or other objects.

This latter apparatus differs from previous multiple test methods, wherein the individual tests are fixed and independent of each other, insofar as the results of the first test are used to adjust the test parameters of the second test. The advantages are:

(1) Only two tests are required to validate a large number of coins;

(2) No mechanical routing of coins to independent tests is required and all coins can follow the same path;

(3) The interdependent nature of the two tests allows the second test to be precisely "tuned" to the coin which the first test has caused it to expect; and (4) Both tests need only be relatively simple, the first because it does not have to distinguish between valid coins and similar non-valid coins, and the second because it has only to make a yes/no decision, thus discriminating against the fakes.

A particular embodiment to be described herein employs a microprocessor to adjust the parameters of the second test in response to the results of the first test. This has the particular advantage that the processor may be programmed differently for different applications, i.e. where the apparatus is required to accept a different series of coins (whether different values within a given country or the coins of different countries).

BRIEF DESCRIPTION OF THE DRAWINGS

Embodiments of the invention will now be described, by way of example only, with reference to the accompanying drawings, in which.

DESCRIPTION OF PREFERRED EMBODIMENTS

Figure 1:
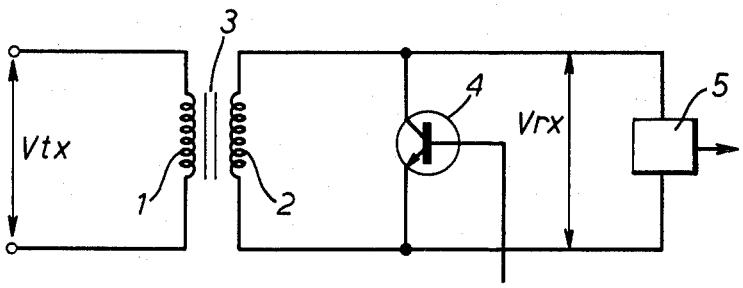
FIG. 1 is a circuit diagram of a coin discriminating apparatus.
Figure 2:
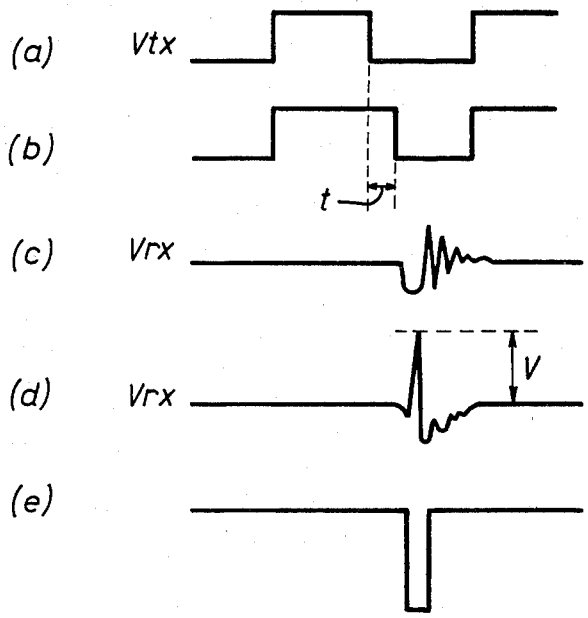
FIG. 2 is a series of waveform diagrams applicable to the apparatus of FIG. 1.

Referring to FIGS. 1 and 2, a coin discriminating apparatus comprises transmitting and receiving coils 1,2 disposed on opposite sides of a path for the passage of coins, a coin 3 under test being shown between the coils. The transmitting coil 1 is connected to a signal generator, such as a current square wave generator, so as to give repetitive abrupt flux changes. A transistor 4 of other switching means is connected across the receiving coil 2 and is driven to short circuit the receiving coil 2 during the time the abrupt flux changes take place but to remove the short circuit a small, predetermined time delay t after each flux change.

FIG. 2 shows at (a) the square wave Vtx applied to the transmitting coil and at (b) a drive signal applied to the base of transistor 4. FIG. 2 further shows at (c) the voltage waveform Vrx appearing across the receiving coil 2 when no coin or other object is disposed between the two coils, and at (d) the voltage waveform Vrx appearing across the receiving coil 2 when a coin is present between the two coils.

The presence of a coin or other object between the two coils affects the waveform Vrx in three ways. Firstly, it affects the manner in which energy from the transmitting coil is coupled into the receiving coil whilst the latter is short circuited; secondly, it affects the manner in which the receiving coil behaves when the short circuit is subsequently removed; and thirdly the receiving coil is affected by energy induced into the coin by the flux changes in the transmitting coil. Changes in the position of the coin, or its physical characteristics, therefore cause changes in the receiving coil waveform Vrx.

FIG. 2(*d*) shows a voltage pulse or spike which is produced across the receiving coil 2 in response to the removal of the short circuit, and which is caused by induced current circulating in the receiving coil immediately prior to removal of the short circuit. The amplitude of this voltage pulse depends upon what object or coin is present between the coils 1,2. Thus, an amplitude responsive means 5 is connected across the receiving coil 2 and is arranged, in the apparatus shown, to provide an output signal in response to a voltage pulse exhibiting a predetermined amplitude V or, preferably, an amplitude lying between upper and lower predetermined limits, indicating the presence of a correct coin.

In the apparatus of FIG. 1, a single preset position of the coin is defined for effecting the test measurement by providing a detector, such as a light path detector, which is responsive to the coin reaching a predetermined position along its path to supply an enabling signal to the amplitude responsive means 5. Also, means are provided for supplying a sampling pulse (waveform (e) in FIG. 2) a predetermined time delay after each removal of the short circuit across receiving coil 2 and coinciding with the occurrence of the voltage pulse (d), which sampling pulse is a further enabling signal for the amplitude responsive means 5. As in the apparatus to be described in connection with FIGS. 5 and 6, the amplitude responsive means is enabled only in the simultaneous occurrence of the sampling pulse and a pulse produced by the light detector in response to the coin reaching its set position.

Figure 4:
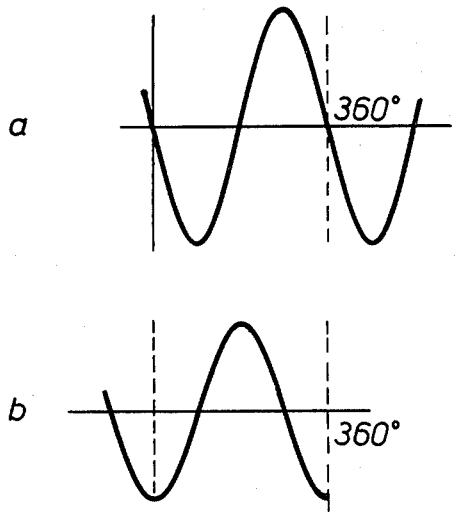
FIG. 4 shows two waveform diagrams applicable to FIG. 3.
Figure 5:
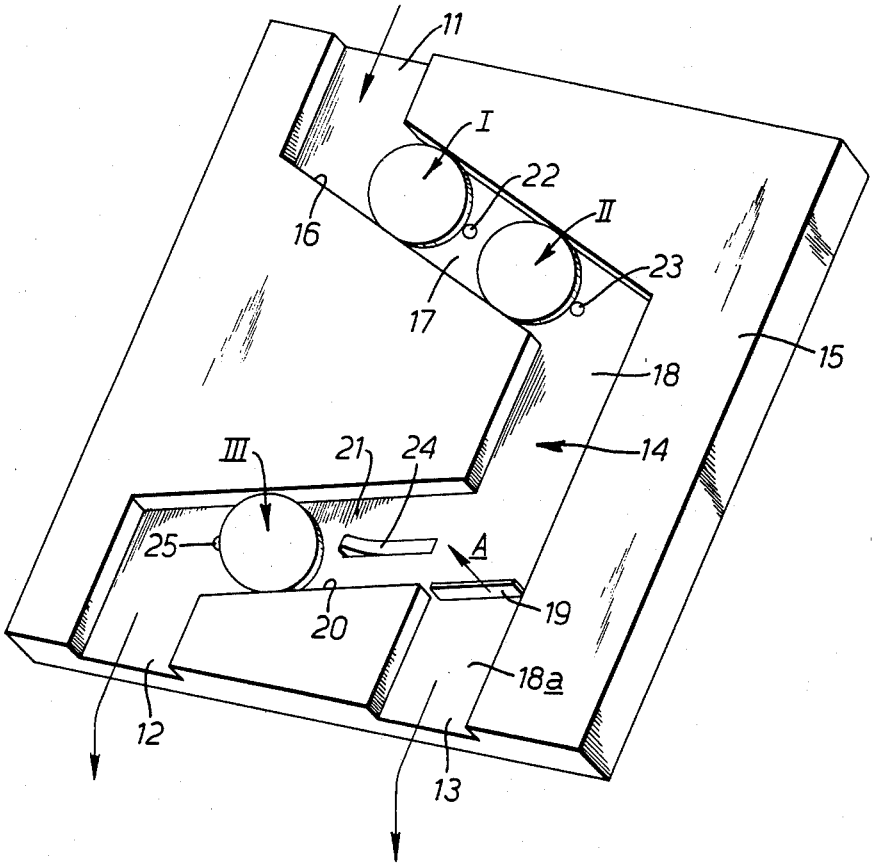
FIG. 5 is a schematic front view of the second coin discriminating apparatus to show the physical layout of certain parts only thereof.
Figures 6, 6A:
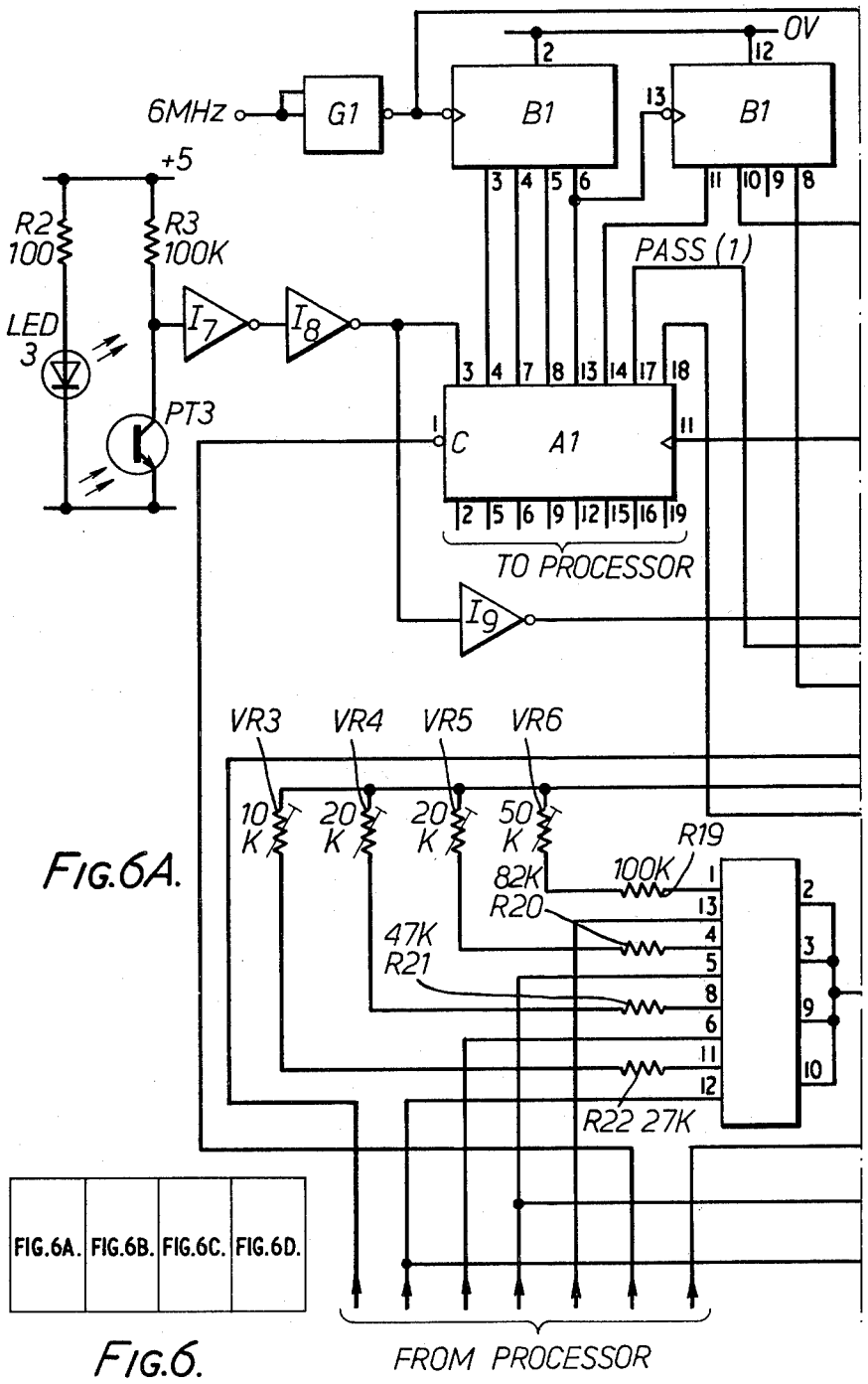
FIGS. 6 and 6A–D are a detailed circuit diagram of the second apparatus.
Figure 6B:
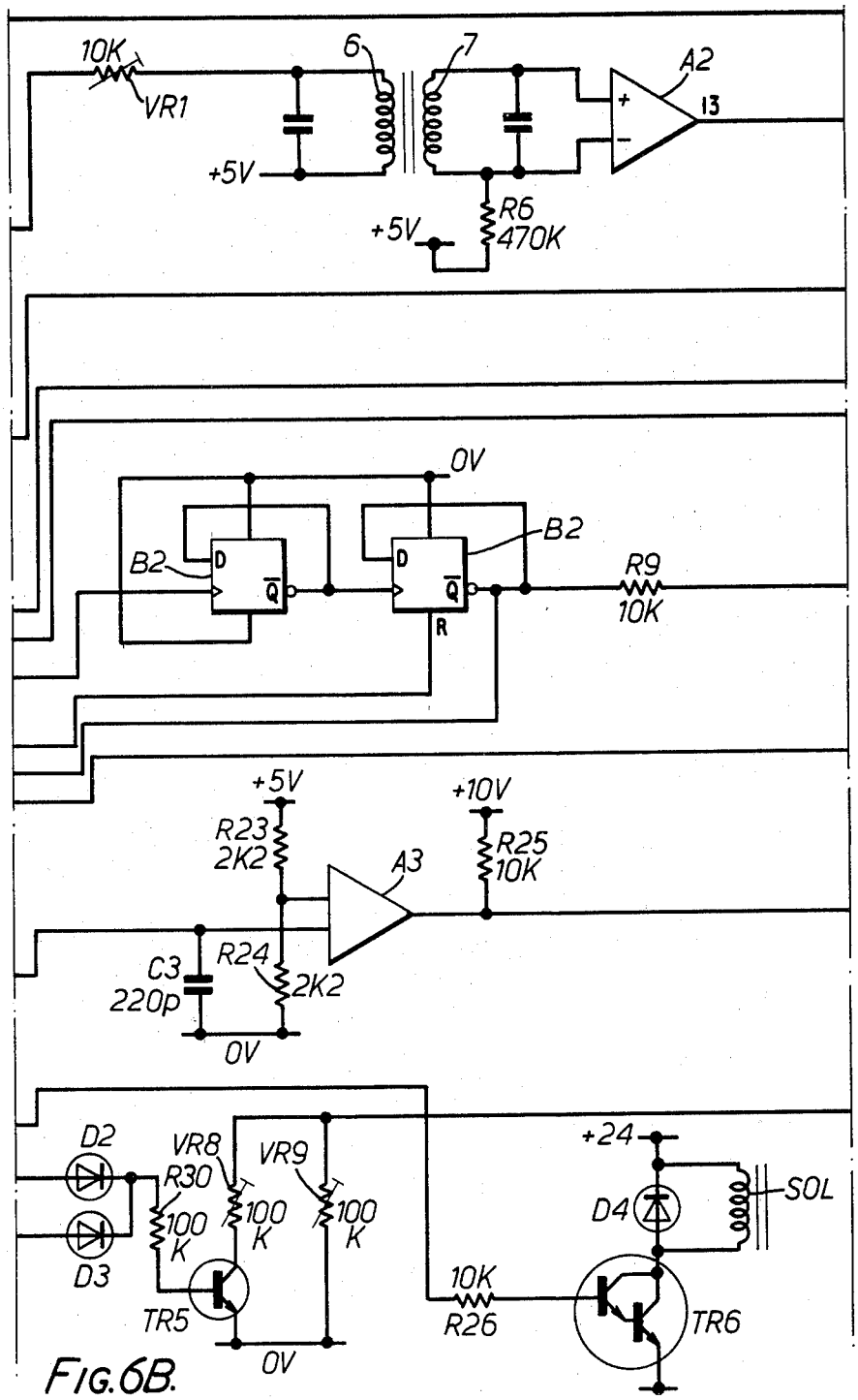
Figure 6C:
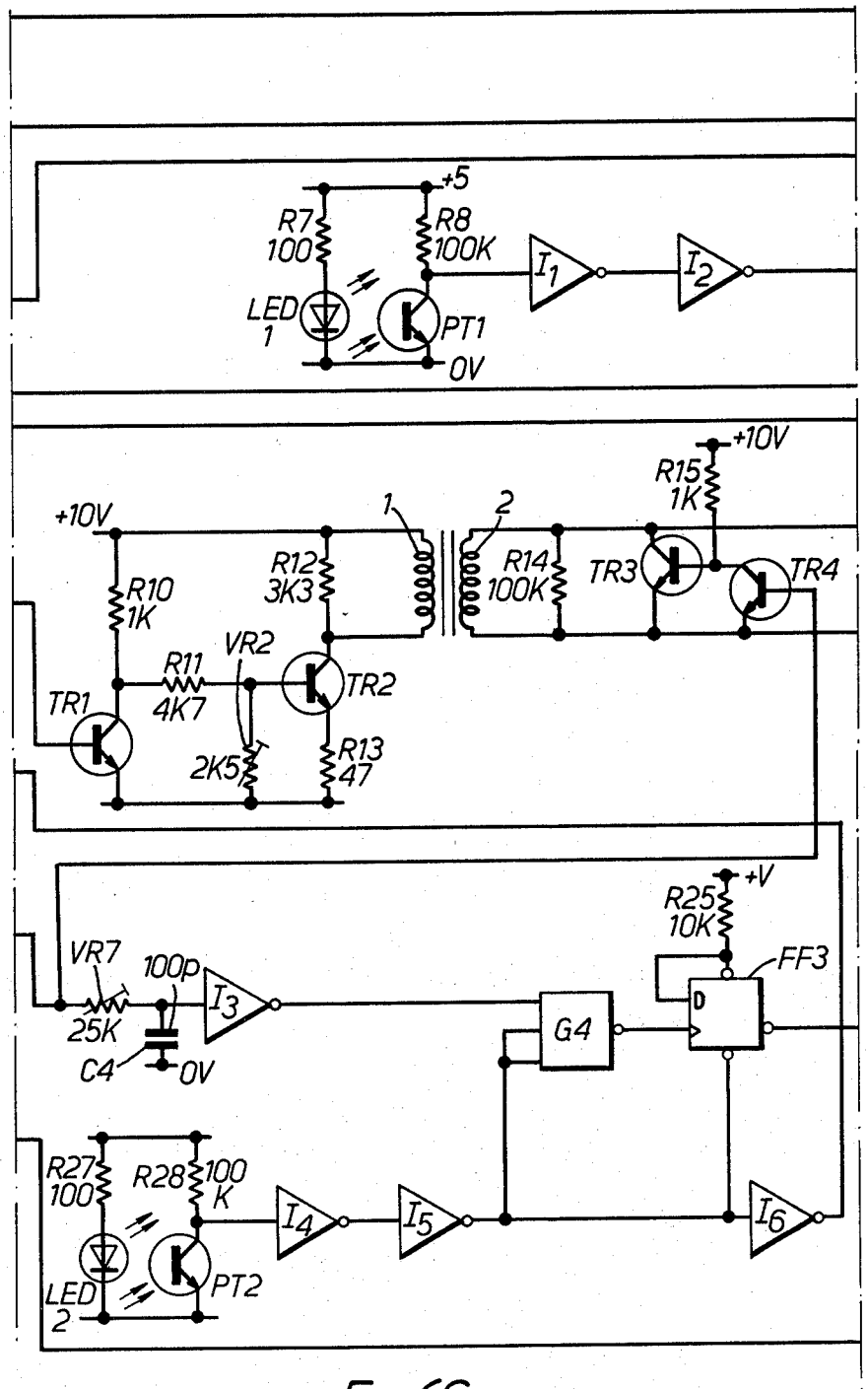
Figure 6D:
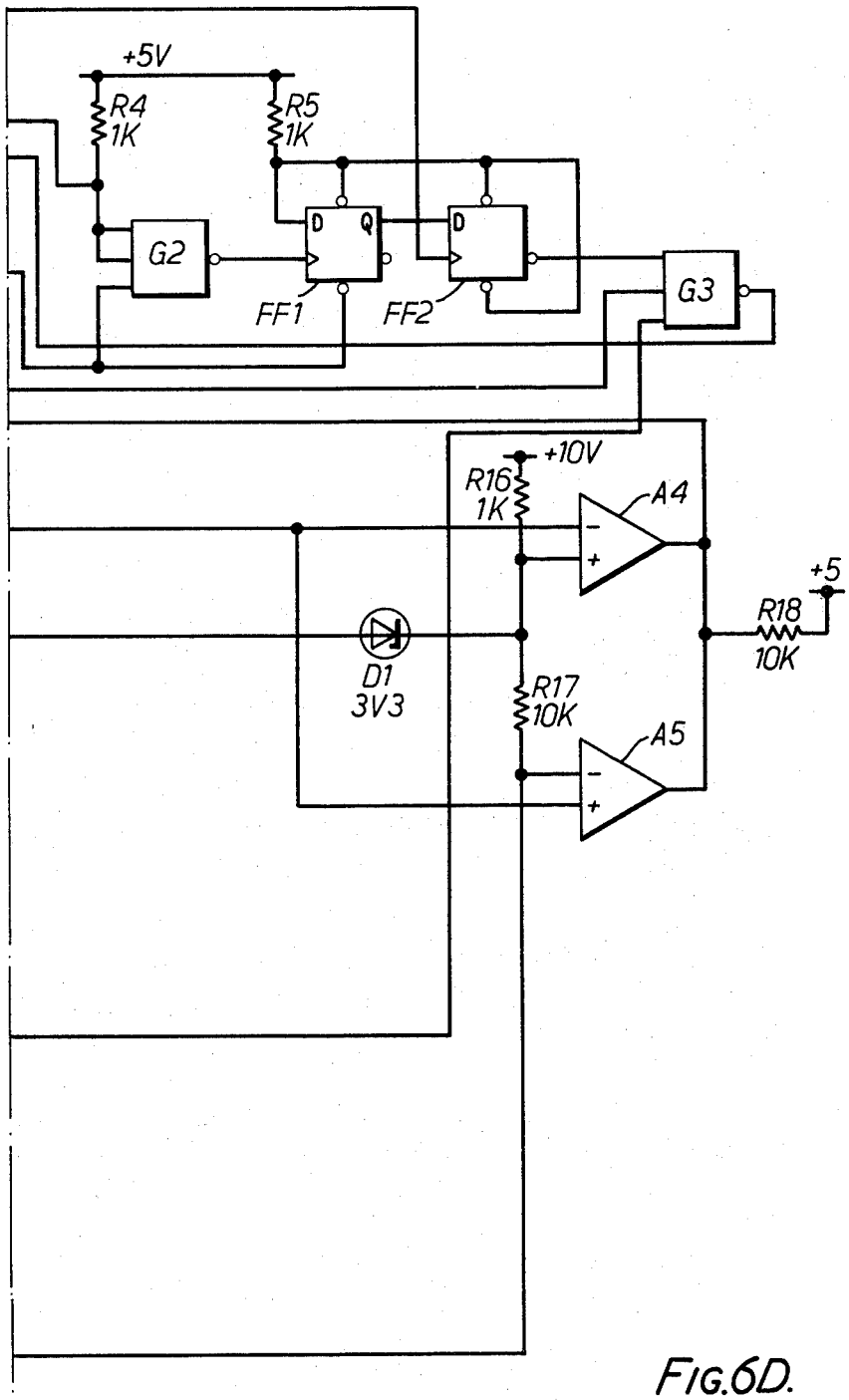

The coin discriminating apparatus shown in FIGS. 5 and 6 is capable of handling a number of valid coin denominations, differentiating between the different valid denominations and discriminating against all non-valid coins or objects. The apparatus carries out two successive tests on each coin, the first test differentiating the different valid coin denominations into categories and providing an output representing one of a number of such categories, and the parameters of the second test being adjusted in response to this output to test specifically for the valid coin denomination which that output represents, thus discriminating against all other coins or objects. The second test is based on the apparatus described in connection with FIGS. 1 and 2, the adjustment being to the delay time t so that a constant voltage pulse amplitude V is expected. The first test will now be described with reference to FIGS. 3 and 4.

Figure 3:
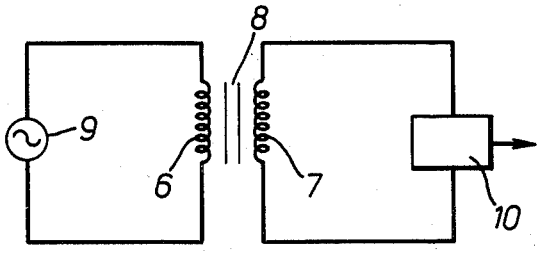
FIG. 3 is a schematic circuit diagram showing the principle of a first testing means in a second coin discriminating apparatus.

Thus, FIG. 3 shows coin testing means for the first test, comprising a transmitting coil 6 and a receiving coil 7 disposed on opposite sides of the path for the coins to be tested, one of which is shown at 8. A sine wave generator 9 is connected to the transmitting coil and a means, indicated diagrammatically at 10, provides an output representing the phase displacement which occurs, when a coin or other object is present, of the signal induced in the receiving coil relative to the signal applied to the transmitting coil. The transmitted and received signals under these circumstances are shown at (a) and (b) in FIG. 4.

This first test is not tuned to detect any particular coin and is not required to measure the phase displacement to great accuracy, as sufficiently large differences in the phase displacement occur for the different denomination coins, and because the second test provides the necessary verification.

The output from the first coin testing means is used to classify the coin into one or another of a number of broad categories, with the aid of a microcomputer. Thus, the computer compares the measured phase displacement value with a look-up table in its memory to categorise the coin and provide the data for adjusting the second coin testing means to test specifically for the expected denomination.

FIG. 5 shows in schematic form the physical layout of the two-test coin discriminating apparatus and FIG. 6 is the detailed circuit diagram. Referring to FIG. 5, a back plate 15 is formed with a channel 14 for passage of coins from an inlet 11 either to an acceptance outlet 12 in the case of correct or valid coins or to a rejection outlet 13 in the case of non-valid coins. The back plate 15 is slightly inclined to the vertical, as shown, so that a coin inserted at 11 (at the top of the back plate) will pass along the channel 14 under gravity with one of its sides always flat against the flat bottom of the channel. Initially, the coin will fall until its edge meets the lower edge 16 of a first inclined portion 17 of the channel, whereafter the coin will roll along this inclined portion to the top of a descending channel portion 18, down which the coin will again fall. Rejected coins will continue to fall down an extension 18*a* of channel portion 18 to the rejection outlet 13. Accepted coins will be deflected by a blade 19, which is driven by an acceptor solenoid across the channel in the direction A, through a slot in the bottom of the channel, so that the accepted coins will roll along the lower edge 20 of a second inclined portion 21 of the channel and then fall to the acceptance outlet 12.

The two tests are carried out on each coin when that coin is at the positions I and II indicated in FIG. 5, both on the inclined portion 17 of the channel. Respective light path detectors 22 and 23 are arranged across the channel to detect the leading edge of the coin when it reaches its testing positions I and II. The two coils 6,7 of the first coin testing means (see FIG. 3) are arranged above and below the channel at the position I and the two coils of the second coin testing means (corresponding to the two coils 1,2 shown in FIG. 1) are arranged above and below the channel at the position II. Because the coins are always in flat contact with the channel bottom, the coins are always precisely positioned relative to two coils at each testing position I and II.

A spring blade 24 is provided as a non-return device and is depressed to the floor of the channel by the weight of a coin to permit the coin to pass, but thereafter prevents withdrawal of the coin, as might be attempted in misuse of the apparatus by passing a coin into the inlet 11 on the end of a string. A third light path detector 25 detects when a coin has safely reached a position III beyond the non-return device 24.

FIG. 6 is the detailed circuit diagram of the apparatus of FIG. 5. The apparatus shown is particularly tailored for discriminating between the German 10pf, 50pf, 1DM, 2DM and 5DM coins in a coin controlled apparatus which will accept all of these coins, totalising the value of the accepted coins. A description of the circuit of FIG. 6 will now be given.

A 6 MHz signal is applied through a NAND gate G1 acting as a buffer to an 8 stage divider circuit comprising integrated circuits B1. The output of the 6th stage of the divider (93.75 KHz) is applied to the transmitting coil 6 of the first testing means through an adjustable resistor VR1, which allows a fine adjustment of the phase shift between the divider output and the coil waveform. The first five stages of the divider are connected to inputs of an 8 input latch circuit A1 enabling measurement of 32 steps of 5.6° over a 180° range. The receiving coil 7 is connected to the inputs of a comparator circuit A2 which detects the zero-crossing of the signal induced in the receiving coil and has its output connected to a NAND gate G2.

The light path detector for the first testing means comprises a light emitting diode LED1 and a phototransistor PT1, the output of which is connected to an inverter I1 having a Schmitt trigger at its input and from thence through an inverter I2 to the NAND gate G2. When a coin reaches its correct position to break the light path between LED1 and PT1, a high level is produced at the output of inverter I2 and therefore the reset input to the D-type flip-flop FF1 is removed. Thus, at the instant of the zero-crossing, a high level is clocked into the D-type FF1, the Q output of which is connected to a further D-type FF2 at which the positive-going edge of said Q output is re-timed by the 6 MHz signal from the output of NAND gate G1. The negative going edge thus produced at the $\overline{Q}$ output of D type FF2 produces a high level at the output of a NAND gate G3, which is applied to clock the 8 input latch A1 and thereby store the state of its counter at the instant of the zero-crossing.

Pins 1,2,5,6,9,12,15,16 and 19 of the latch are connected to a micro-processor system (model 8080 by Intel) and the processor checks the state of the latch A1 every 2 ms and will read in the state of count which is reached at the instant of the zero-crossing, which count represents the phase displacement between the transmitting and receiving coils 6,7. The processor compares this phase displacement value with its look-up table and determines if the coin is identified as one of the five valid coin denominations, in which case it resets the latch A1 and adjusts the second testing means appropriately.

The final stage output of the divider B1 is applied to a further divider, comprising two D-type flip-flops B2, to produce a 6 KHz, square wave output. The reset input R of this divider is controlled by the processor so that this 6 KHz output is only produced in response to completion of the first test and cannot interfere with the measurement effected in the first test. The 6 KHz square wave drives a current source, comprising transistor TR2, through a transistor TR1 and the square wave current source output is applied to the transmitting coil 1 of the second testing means.

The 6 KHz output is also passed to an R-C delay circuit comprising a selected one of the four variable resistors VR3,VR4,VR5,VR6 (in series with their respective fixed resistors R22,R21,R20,R19) and capacitor C3. A selector switch S connects the selected series resistors chain to the upper terminal of capacitor C3 under the control of the processor and according to which valid coin denomination it recognises as a result of the first test. A comparator A3 reshapes the output of the RC delay circuit and produces a square wave which is delayed by the time t relative to the square wave applied to transmitting coil 1. The value of t is thus adjusted according to which coin denomination is recognised as a result of the first test. Owing to their similar properties, the time delay t required for the German 10pf and 50pf coins is the same, to give rise to a voltage spike of constant amplitude in the second testing means. Thus, the same resistor chain is selected for both coins and the second test verifies, in this case, that the coin is either a 10pf or 50pf coin. Discrimination between these two coins is made by the processor on the basis of the phase displacement measurement made by the first testing means.

The delayed square wave from the comparator drives a transistor TR3 through a transistor TR4, the transistor TR3 serving as the short circuiting transistor 4 of FIG. 1 relative to receiving coil 2. The delayed square wave is also used to produce the sample pulse (e) of FIG. 2, by application to an RC delay circuit VR7, C4 and thence to an inverter I3 provided in its input with a Schmitt trigger, providing the negative-going sample pulse which is applied to an input of a NAND gate G4.

The second light path detector, comprising LED2, PT2, inverters I4,I5 and identical with the first light path detector, produces a prolonged high level output commencing when the coin reaches its correct position and continuing until the trailing edge of the coin has passed, and this high level output is applied to the NAND gate G4 and reset terminal of a D-type flip-flop FF3. The effect is that the sample pulse causes the D-type flip-flop FF3 output to go to its low level, thus passing a high level signal from the output of NAND gate G3, clocking the latch circuit to receive information at its pins 17 and 18. The high level from the light path detector is also applied through an inverter I6 to pin 18 of the latch to provide the information that the second test is being made.

The voltage spike, produced in the receiving coil 2 upon removing the short circuit applied by transistor TR3, is applied to the respective negative and positive inputs of two comparators A4,A5. If the amplitude of the spike lies between the upper and lower limits set by these comparators, then an output signal is applied to pin 17 of the latch A1.

The third light path detector comprises LED3, PT3 and inverters I7,I8 and is identical with the first and second detectors. When the light path is broken by the coin reaching position III (FIG. 5), a low level appears at the output of a further inverter I9 and is applied to NAND gate G3, producing a high level output which clocks the latch A1 to receive the information at its pin 3, from inverter I8, that the light path has been broken.

The processor responds to the information in the latch that the second and third tests have been made with positive results to record which denomination of coin has been accepted. If the coin satisfies the first and second tests, a transistor TR6 is rendered conductive to energise the acceptor solenoid SOL which drives the deflector 19 (FIG. 5).

It is found that the properties of the German 10pf, 50pf and 2DM coins vary considerably, as compared to the 1DM and 5DM coins. Thus, if one or other of these three coins is recognised by the first test, the "window" defined by comparators A4,A5 is enlarged in that the processor renders a transistor TR5 conductive, which transistor is in parallel with a variable resistor VR9 in the series resistor chain VR9,R17,R16 into which the respective positive and negative inputs of the two comparators are connected.

Figure 7:
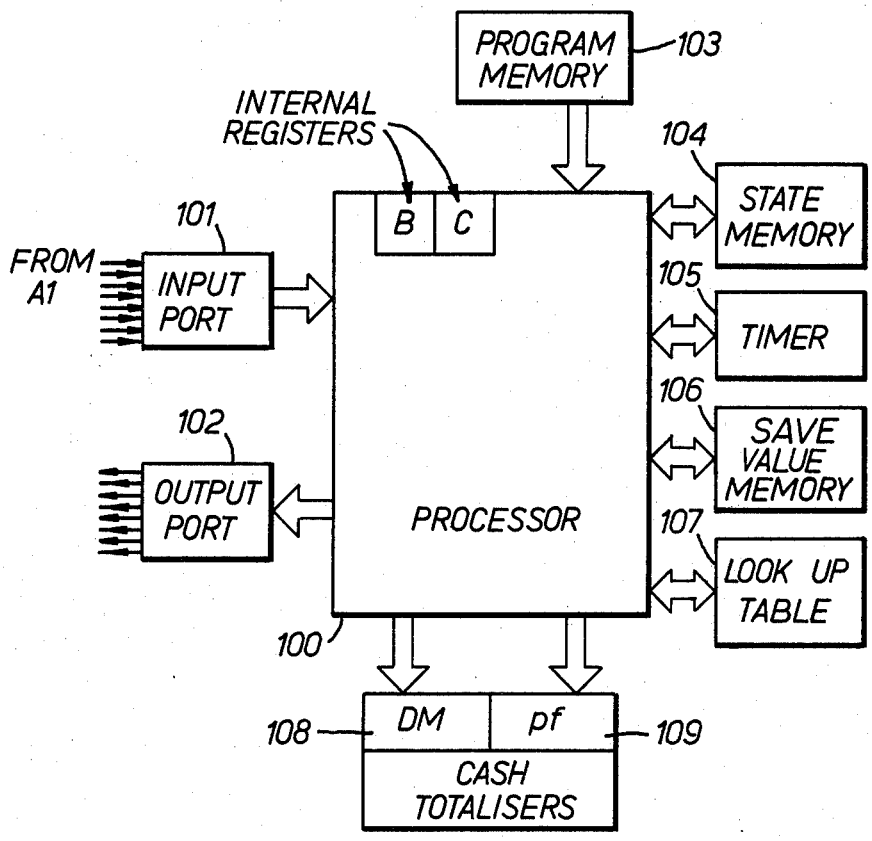
FIG. 7 is a block diagram of a microcomputer employed in the circuit of FIG. 6.

Referring to the block diagram of FIG. 7, the microcomputer comprises a processor 100 with internal registers B,C and input and output ports 101,102. It also includes a program memory 103, a state memory 104, a timer 105, a "save value" memory 106, and the look-up table 107. It moreover includes cash totalisers 108,109, one totalising DM and the other totalising pfennings.

The 8 bits 0–7 of the input port are connected to pins 2,5,6,9,12,15,16 and 19 respectively of the latch A1 as shown in FIG. 6. Bit 0 responds to the 3rd test, bit 6 to a success on the 2nd test, bit 7 to the 2nd test being in process and bits 1 to 5 respond to the phase angle measurement provided by latch A1. The output of latch A1 is normally all zero's and the latch is examined every 2 ms by the processor. When the coin acceptor has information, the latch outputs are no longer all zero's and the processor reads in the latch information and resets the latch by means of bit 6 of its 8 bit output. Bit 7 of this output controls the accept solenoid SOL, bit 0 the reset of divider B2, bit 1 indicates if a 10pf coin is detected on the 1st test, bit 2 indicates if either a 50pf or 10pf is detected on the 1st test and bits 3–5 indicate if a 1DM, 2DM of 5DM coin, respectively, is detected on the 1st test (to control the selector S accordingly).

System operation is defined in terms of four states, which occur at various stages in the passage of the coin through the apparatus. State 0 is the reset state, when nothing is happening. State 1 is the state where a coin has satisfied the first test, but has not reached the second test. State 2 is where the coin has satisfied both the first and second tests, but has not yet reached the third test. State 3 is a reject state, for example if the coin has failed one of the tests. The current state is stored in the state memory 104.

Figure 8A:
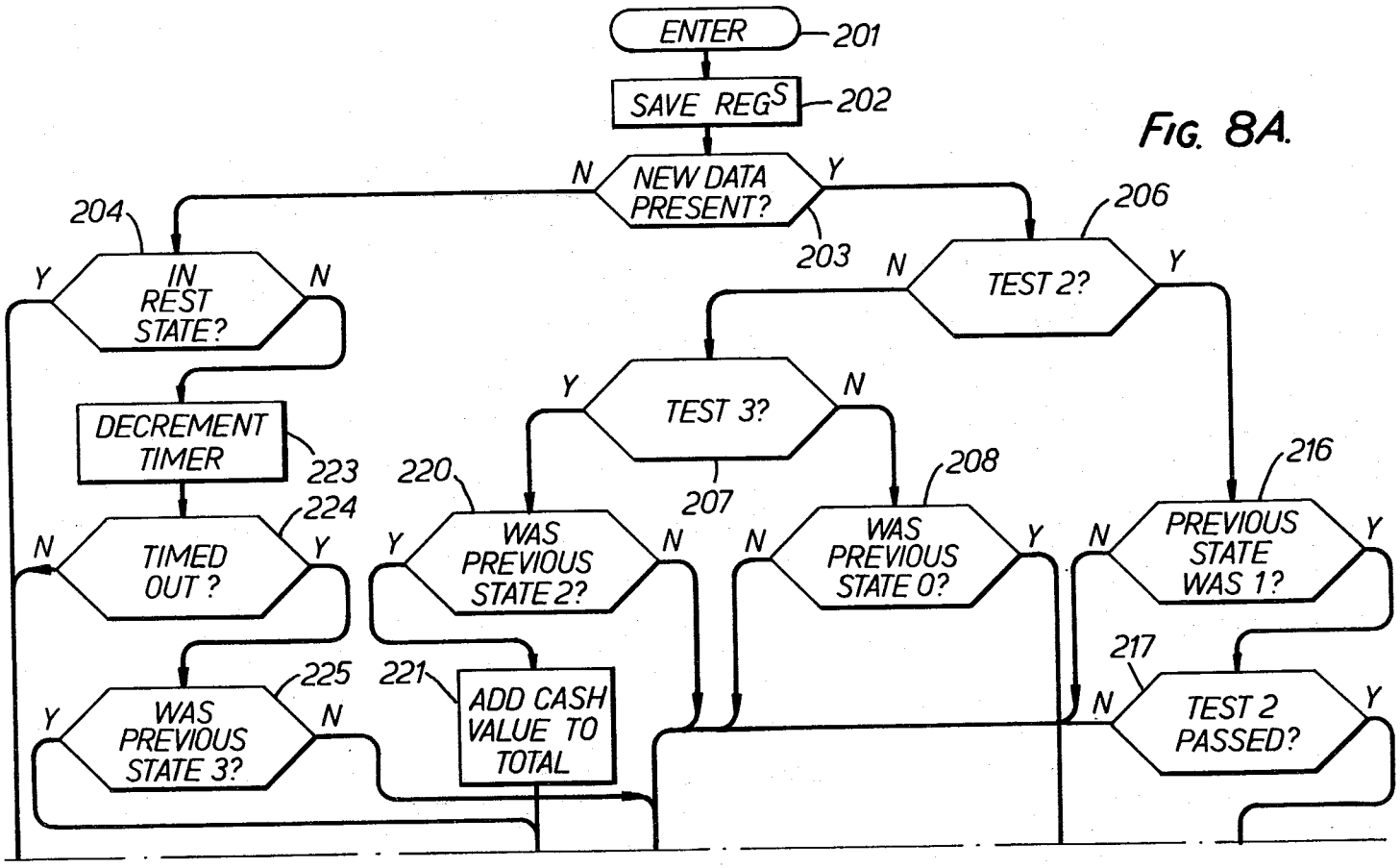
FIGS. 8A–B are a flow diagram of the microcomputer program, coin testing routine.
Figure 8B:
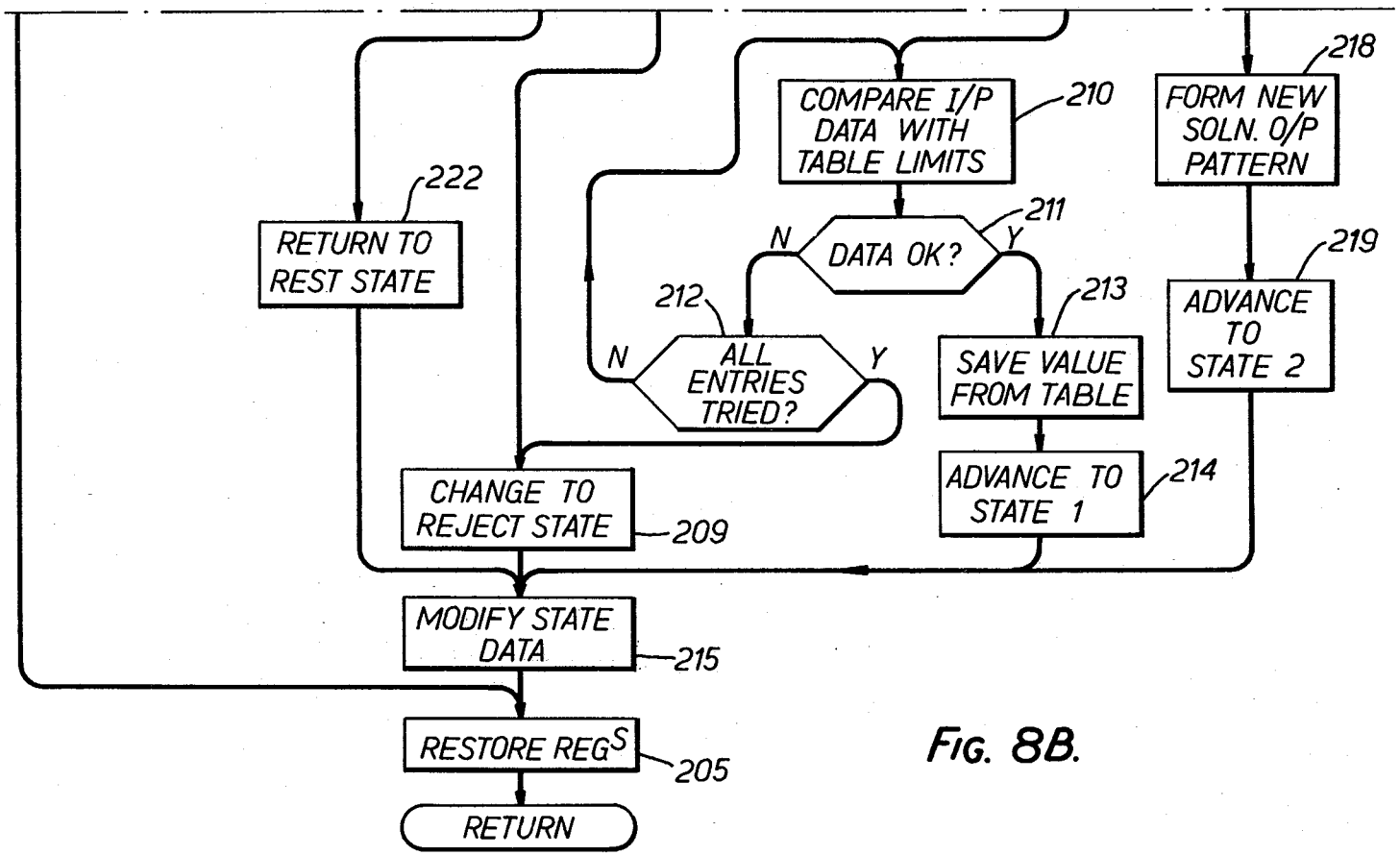

Referring to FIGS. 8A and 8B, every 2 ms the processor examines the latch A1 and enters (201) the latch data. Information currently in the processor registers is saved (202) whilst the data from the latch is examined. When no new coin has been inserted, the test (203) as to whether the latch holds new data will be negative, and test 204 will show that the system is in the rest state 0: the processor registers will be restored at 205 and the processor will return to its 2 ms timing cycle.

Upon the arrival of a new coin, test 203 will show new data and if neither the second coin test (206) nor the third coin test (207) is in process (thus assuming that the first coin test is in process), 208 checks that the previous state was the rest state 0. With a negative result, a change to the reject state would take place (209), otherwise the measurement results of the first coin test are compared (210) with the data stored in the look-up table 107. This look-up table contains the measurement limits and coin value for each of the allowable coins, plus for each coin the output command to pass to the selector 5. The measurement results of the first coin test are compared at 210 with the limits, stored in the look-up table, for each possible coin in turn: if the measurement results do not satisfy the limits for the first coin (negative at 211), and then a negative is obtained at 212, then the measurement results are compared with the stored limits of the next coin until either all possible coins have been tried without success (causing a change at 209 to the reject state), or else an allowable coin has been recognised at 211. In the latter event, the value of the recognised coin is passed (213) from the look-up table to the save value memory 106, and the system advances (214) to state 1. At 215, the state memory 104 is up-dated and the output port is appropriately modified in readiness for the second coin test, the processor registers are restored at 205 and the processor returns to its 2 ms timing cycle.

When, in response to the second coin test, new data is recognised at 203, and the second test is recognised at 206 as being in progress, 216 checks that the previous state stored in state memory 104 was state 1, and 217 checks if the second coin test is satisfied. If either 216 or 217 produces a negative response, a change to the reject state is made at 209. With a positive indication from 217, the accept solenoid SOL is pulled in at 218 and the system advances to state 2 at 219, with 215 up-dating state memory 104 and modifying the output port.

When, in response finally to the third coin test, new data is recognised at 203, and the third test is recognised at 207 as being in progress, 220 checks that the previous state stored in state memory 104 was state 2, 221 adds the cash value stored in save value memory 106 to the totalisers 108,109 and 222 returns the system to the rest state. If a negative indication is given at 220, the system is changed to the reject state (209).

The timer 105 is effective to change the system to its reject state 3 if the coin fails to reach the second test within a predetermined time after satisfying the first test, or if the coin fails to reach the third test within a predetermined time after satisfying the second test. Also, the timer 105 changes the system to its rest state 0 after a predetermined time in the reject state 3, which time is sufficient for a rejected coin to leave the apparatus before a new coin can be accepted. Thus, when any fresh examination of the latch A1 data (at the 2 ms intervals) first reveals at 203 no new data, and at 204 that the system is not in rest state 0, the timer 105 is decremented (223). Whilst the periodic examinations of the latch A1 data continue to show no new data and the timer is not yet timed out, 224 produces no change in the system and the processor registers are restored at 205. However, once the timer is timed out at 224, the system is changed to the reject state (209), unless the previous state was state 3 in which case the change is to the rest state 0 via 222. The timer is set at 213,217 or 209 and reset at 215.

Figure 9:
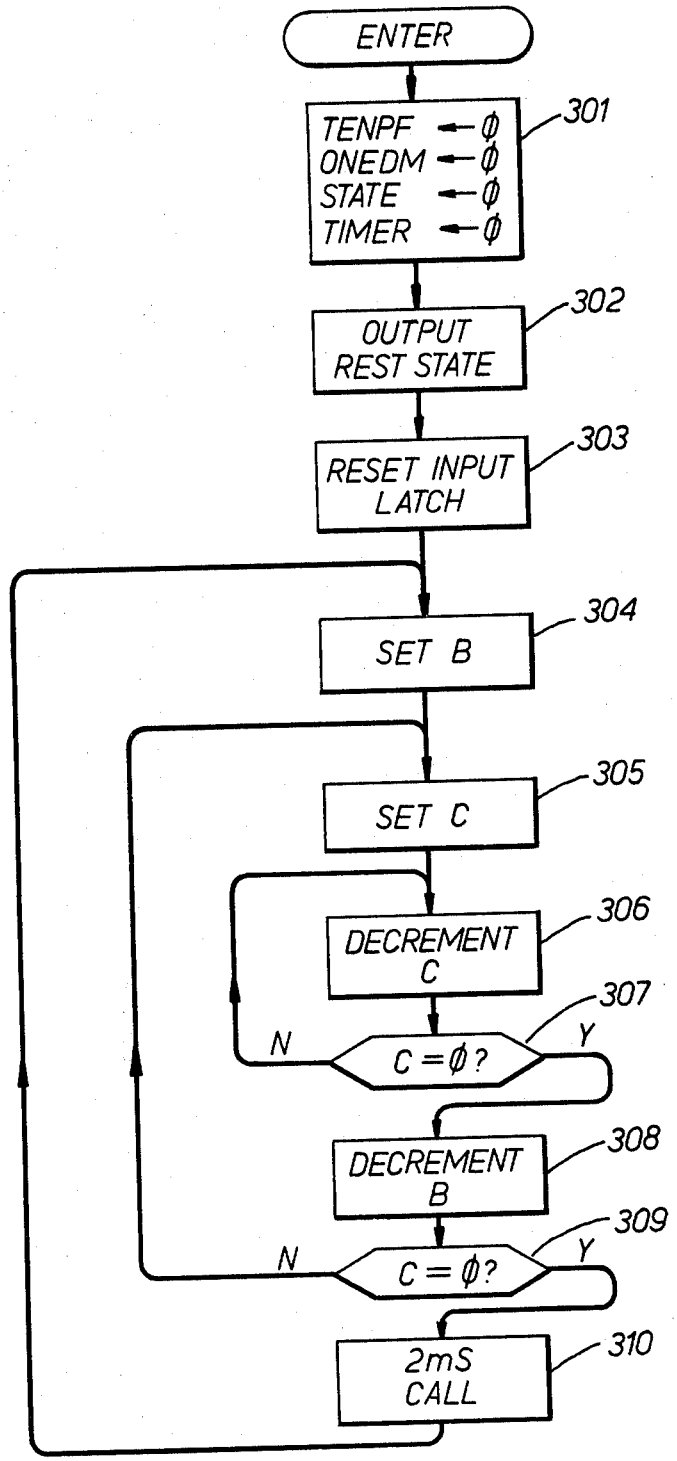
FIG. 9 is a flow diagram of the main program of the microcomputer.

The 2 ms timing cycle of the processor is provided by a dummy real time clock program shown in FIG. 9. When the apparatus is initially energised, the totalisers 108,109, the state memory 104 and the timer 105 are reset to zero (301). The output port is reset to its rest state outputs (302) and the latch A1 is reset (303). 304 represents register B of the processor and its count is reset to equal the number of ms per call (i.e. 2). 305 represents register C of the processor and its count is reset sufficiently high to provide a 1 ms delay. Thus, for each decrement by one unit, at 306, of the preset count in C, 307 checks if the count C is zero and, until it is zero, 306 decrements a further unit from count C: when count C is at zero, 308 decrements count B by one unit and if this does not render count B at zero, the operation is repeated until the count in B is indeed zero (309), at which point the call is made (310) to the latch A1. Then the counts in B and C, are reinstated 304,305 to repeat the entire 2 ms cycle.

Figure 10:
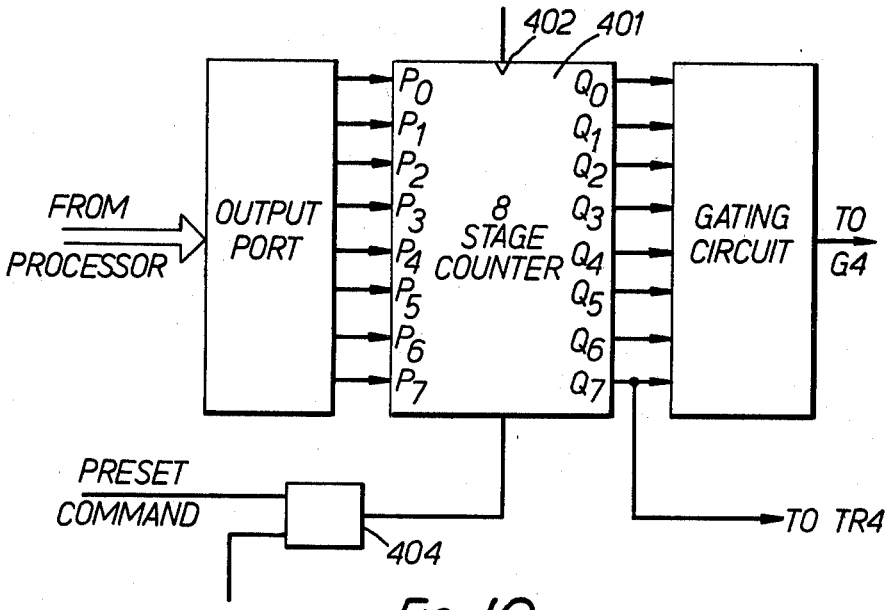
FIG. 10 is a diagram of a modification to the circuit diagram of FIG. 6.

It will be noted that the delay selector S shown in FIG. 6 operates in an analogue fashion. However, the control could instead be digital. Thus, referring to FIG. 10, the selector S, selectable resistors and comparator A3 of FIG. 6 may be replaced by an 8-stage presettable counter 401 having its 8 inputs $P_0$–$P_7$ driven by the processor output port, its clock 402 driven from pin 4 of divider B1 in FIG. 6 and its preset 403 driven by an AND gate 404, the inputs of which comprise a preset command line from the processor and a line from the main counter B2. Of the outputs $Q_0$–$Q_7$ of the counter 401, $Q_7$ provides the drive for transistor TR4 and $Q_0$–$Q_7$ are connected to a gating circuit providing the delayed sample pulse to G4 in a digital manner instead of by VR7 and C4.

Figure 11:
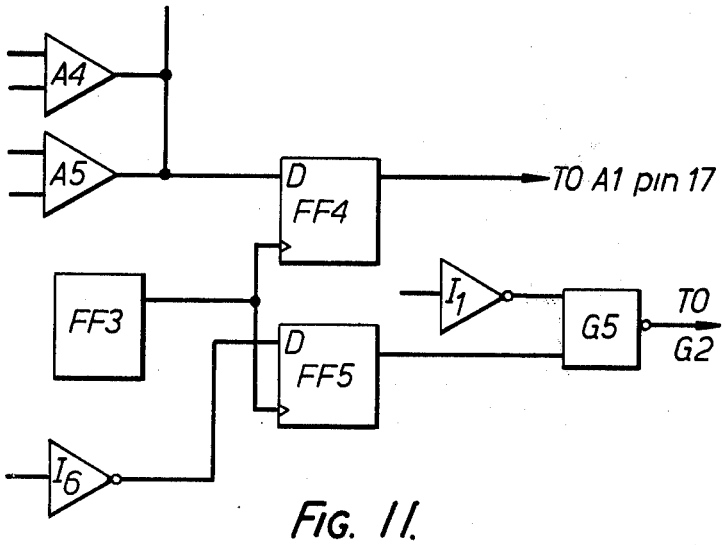
FIG. 11 is a diagram of another modification to the circuit diagram of FIG. 6.

The circuit of FIG. 6 described, in the first test, measures the absolute phase displacement between transmitting and receiving coils 6,7. Instead, the phase displacement could be measured relative to that which occurs with no coin present. The processor then requires regular notification of the no-coin phase shift in order to correct for temperature or long term changes. The no-coin phase shift may be checked at the time each coin reaches the second test, the no-coin phase shift information being sent to the processor at the same time as the result of the second test. Referring to FIG. 11, an additional D-type flip-flop FF4 receives the output of the comparators A4,A5, and the output of flip-flop FF3 is also taken to flip-flop FF4 instead of to gate G3. This additional flip-flop FF4 thus holds the result of the second test until the no-coin zero-crossing of the first testing means occurs, at which instant all information (second test result and no-coin first test result) is clocked into latch A1. In this regard, the no-coin first test is initiated by the output of inverter I6 and the output of flip-flop FF3 controlling a further D-type flip-flop FF5, in response to the coin being detected at its position for the second test: the resulting output from flip-flop FF5 is passed by a further NAND gate G5 (replacing inverter I2) to gate G2 to effect the no-coin first test measurement, at the end of which (as previously described) gate G3 clocks latch A1 to receive the no-coin first test information and also the second test information. The first test result for that particular coin has already been compared with a stored no-coin value and that coin will be rejected if the no-coin value requires excessive up-dating, but the rejected run of the coin through the apparatus will effectively up-date the stored no-coin value so that the coin will be correctly accepted on a second run through the apparatus.

The component values of the circuit are shown in FIG. 6, the pin connections of the integrated circuits A1,B1 and S being as shown. Latch A1 is circuit 74LS273 and the two circuits B1 comprise circuit 74393, both Texas Instruments. The two circuits B2 comprise circuit MC14013 and circuit S is MC 14016, both by Motorola. The four comparators comprise LM 339 by National Semiconductors, the NAND gates comprise circuit 7410, except G1 which is 7400, both by Texas Instruments, D-types FF1, FF2 and FF3 comprise Texas Instruments 7474, inverters I1,I3,I4 and I7 are Texas circuits 74C14 and the other inverters are Texas circuits 7404. The four coils 1,2,6,7 are identical and each comprises 300 turns of 0.016 mm diameter enamelled copper wire wound on a 15 mm diameter former.

I claim:

1. A coin discriminating apparatus, comprising a transmitting coil connected to a signal generator so as to give an abrupt flux change, a receiving coil, the transmitting and receiving coils being disposed on opposite sides of a path for the passage of coins, means for short circuiting the receiving coil but effective to remove the short circuit a predetermined time delay after said flux change, and means responsive to the amplitude of a voltage pulse which is produced across the receiving coil in response to removal of said short circuit.

2. An apparatus as claimed in claim 1, in which the signal generator is arranged to apply a square wave signal to the transmitting coil.

3. An apparatus as claimed in claim 1, further comprising means for generating a sample pulse a predetermined time delay after removal of said short circuit, which sample pulse is supplied as an enabling signal to the amplitude responsive means.

4. An apparatus as claimed in claim 1, in which the amplitude responsive means is arranged to provide an output signal in response to a said voltage pulse of magnitude between predetermined upper and lower limits.

5. An apparatus as claimed in claim 1, further comprising a detector responsive to a coin reaching a predeterming position along said path, to supply an enabling signal to the amplitude responsive means.

6. An apparatus as claimed in claim 5, in which said detector comprises a light path detector.

7. A coin discriminating apparatus, comprising:

a path for the passage of coins in a given direction;

first coin testing means associated with said path and arranged for carrying out a first test on a coin and to provide a first test result indicating to which of a number of valid denominations the coin belongs; and second coin testing means associated with said path and arranged for carrying out a second test on the coin which second test is controlled in dependence upon the first test result to test the coin specifically for the valid coin denomination indicated by the first test result;

said second coin testing means including:

a transmitting coil;

a pulse generator connected to said transmitting coil and arranged to apply an electrical pulse to said transmitting coil to thereby subject a coin undergoing the second test to a magnetic field thus produced; and a receiving coil associated with said transmitting coil, an electrical output signal being induced therein in response to the pulse applied to said transmitting coil.

8. An apparatus as claimed in claim 7, including a microprocessor arranged to respond to said first test result and control said second test in dependence thereupon.

9. An apparatus as claimed in claim 8, in which said second coin testing means comprises means for short circuiting said receiving coil but effective to remove that short circuit a predetermined time delay after the trailing edge of said pulse, said microprocessor being arranged to adjust said time delay in accordance with said first test result, and means responsive to the amplitude of a voltage spike produced across said receiving coil in response to removal of the short circuit.

10. An apparatus as claimed in claim 9, in which the first coin testing means comprises an a.c. signal generator, a transmitting coil connected to said a.c. signal generator, a receiving coil associated with that transmitting coil and means responsive to the phase displacement of a corresponding a.c. signal induced in that receiving coil, when a coin is present, to provide an output as a function of said phase displacement.

11. An apparatus as claimed in claim 10, in which said phase displacement responsive means comprises a counter and means for sampling the counter in response to said induced a.c. signal crossing its zero level.

12. An apparatus as claimed in claim 10, in which said phase displacement responsive means is arranged to provide its output in the absence of any coin and said first coin testing means is arranged to determine said first test result as a function of the phase displacement occurring when a coin is present compared with the phase shift occurring in the absence of a coin.

13. An apparatus as claimed in claim 12, in which said phase displacement responsive means is arranged to provide a coin-absent output whilst the second test is being carried out.

14. A method of coin discrimination, comprising:

subjecting a coin to a first test to provide a first test result indicating to which of a number of valid coin denominations the coin belongs; and then subjecting the same coin to a second test, in which the second test is controlled, in dependence upon the first test result, to test specifically for the valid coin denomination indicated by said first test result;

the second test comprising applying an electrical pulse to a transmitting coil and subjecting the coin to the magnetic field thus produced, and examining an electrical signal thereby induced in an associated receiving coil.

15. A method as claimed in claim 14, comprising using a microprocessor to control the second test in dependence upon the first test result.

16. A method as claimed in claim 15, in which the second test comprises removing a short circuit from across said associated receiving coil a predetermined time delay after the trailing edge of said applied pulse, which time delay is adjusted by said microprocessor in dependence upon the first test result.

* * * * *